US008274444B2

(12) United States Patent
Shih et al.

(10) Patent No.: US 8,274,444 B2
(45) Date of Patent: Sep. 25, 2012

(54) ANTENNA DEVICE

(75) Inventors: Kai Shih, Taipei (TW); Yu-Yuan Wu, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 358 days.

(21) Appl. No.: 12/783,571

(22) Filed: May 20, 2010

(65) Prior Publication Data

US 2011/0285601 A1 Nov. 24, 2011

(51) Int. Cl.
*H01Q 1/48* (2006.01)

(52) U.S. Cl. ..... 343/848; 343/700 MS

(58) Field of Classification Search ..... 343/700 MS, 343/702, 846, 848
See application file for complete search history.

(56) References Cited

U.S. PATENT DOCUMENTS

| | | | | |
|---|---|---|---|---|
| 6,753,817 | B2 * | 6/2004 | Aikawa et al. | 343/700 MS |
| 2010/0013730 | A1 * | 1/2010 | Azhari | 343/848 |
| 2011/0285600 | A1 * | 11/2011 | Lin et al. | 343/848 |

* cited by examiner

*Primary Examiner* — Tan Ho
(74) *Attorney, Agent, or Firm* — Lin & Associates IP, Inc.

(57) ABSTRACT

An antenna device includes an insulating substrate, a ground plane, a radiating element, a horizontal feed probe and a vertical feed probe. The insulating substrate has a first surface and a second surface opposite to the first surface. One end of the first surface defines an insulating area. One end of the second surface adjacent to the insulating area defines a first isolating area, a second isolating area, a horizontal feed circuit and a vertical feed circuit. The ground plane includes a first ground plane and a second ground plane. The radiating element is located onto the insulating area. The horizontal and vertical feed probes are inserted in the insulating substrate and the radiating element with one end thereof projecting beyond the radiating element and the other end thereof respectively penetrating through the first and second isolating areas so as to couple with the horizontal and vertical feed circuits, respectively.

7 Claims, 6 Drawing Sheets

ANTENNA DEVICE

BACKGROUND OF THE INVENTION

1. Field of the Invention

The present invention generally relates to an antenna device, and more particularly to a dual-polarized patch antenna device.

2. The Related Art

Currently, game machines and other consumer electronic products are more and more miniaturized and multi-functionalized. So, an antenna device used to transmit and receive electromagnetic signals is developed towards miniaturization and reliability.

A conventional antenna device is widely used in the game machines depending on its characteristics of small dimensions and omnidirectional radiations. The conventional antenna device generally includes a radiating element, a ground plane, and an insulating substrate located between the radiating element and the ground plane. The radiating element is propped on the insulating substrate through insulating pillars so that some space can be formed between the radiating element and the insulating substrate. The antenna device defines a feed hole vertically penetrating through the insulating substrate and the ground plane. A feed cable passes through the feed hole to make a coupling feed with the radiating element. However, the antenna device works at simplex communication, and the insulating pillars need to be propped the radiating element on the insulating substrate that results in a complicated manufacturing procedure and a larger dimension of the antenna device.

SUMMARY OF THE INVENTION

An object of the present invention is to provide an antenna device. The antenna device includes an insulating substrate, a ground plane, a radiating element, a horizontal feed probe and a vertical feed probe. The insulating substrate has a first surface and a second surface opposite to the first surface. One end of the first surface defines an insulating area. One end of the second surface adjacent to the insulating area defines a first isolating area and a second isolating area spaced from the first isolating area. A horizontal feed circuit and a vertical feed circuit are disposed at the one end of the second surface and beside the first isolating area and the second isolating area, respectively. The ground plane includes a first ground plane which is covered on the first surface of the insulating substrate with the insulating area being exposed outside, and a second ground plane which is covered on the second surface of the insulating substrate with the first and second isolating areas being exposed outside and is further electrically connected with the first ground plane. The radiating element is located onto the insulating area of the insulating substrate. The horizontal feed probe and the vertical feed probe are inserted in the insulating substrate and the radiating element with one end thereof projecting beyond the radiating element and the other end thereof respectively penetrating through the first isolating area and the second isolating area so as to couple with the horizontal feed circuit and the vertical feed circuit, respectively.

As described above, the antenna device uses direct feed mode, and the proper arrangements of the horizontal and vertical feed probes on the radiating element can make the resonance impedance reach a better effect and reduce the occupying area of the radiating element. And the radiating element is located onto the insulating substrate so as to manufacturing technologies of the antenna device are simplified.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
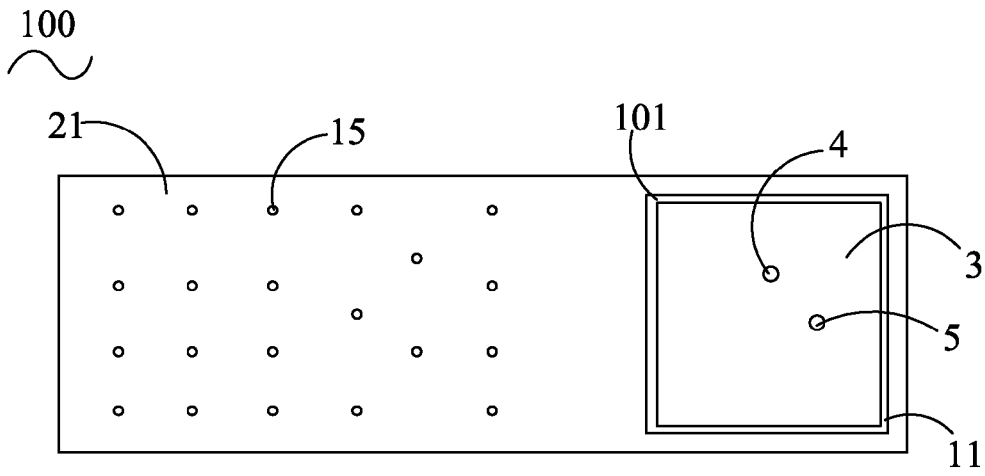
FIG. 1 is a vertical view of an antenna device in accordance with the present invention.
Figure 2:
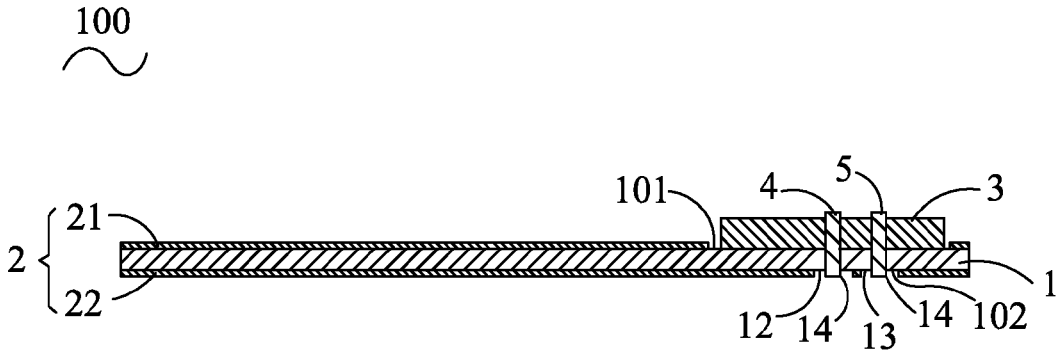
FIG. 2 is a lateral cross-sectional view of the antenna device of FIG. 1.

With reference to FIG. 1 and FIG. 2, an antenna device 100 in accordance with the present invention is shown. The antenna device 100 includes an insulating substrate 1, a ground plane 2, a radiating element 3, a horizontal feed probe 4 and a vertical feed probe 5.

Figure 3:
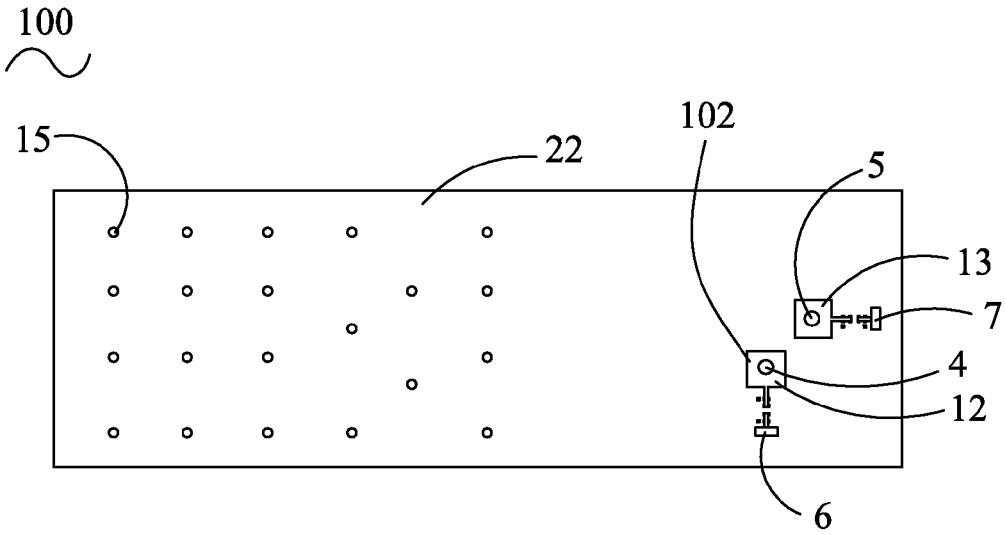
FIG. 3 is an upward view of the antenna device of FIG. 1.

Referring to FIGS. 1-3, the insulating substrate 1 is of a rectangular board configuration and has a first surface 101 and a second surface 102 opposite to the first surface 101. One end of the first surface 101 of the insulating substrate 1 defines a square insulating area 11. One end of the second surface 102 of the insulating substrate 1 adjacent to the insulating area 11 defines a square first isolating area 12 and a square second isolating area 13 spaced from each other, and further is provided with a horizontal feed circuit 6 and a vertical feed circuit 7 respectively located beside the first isolating area 12 and the second isolating area 13. The first surface 101 and the second surface 102 of the insulating substrate 1 are respectively covered by a layer of metal to form a first ground plane 21 with the insulating area 11 being exposed outside and a second ground plane 22 with the isolating areas 12, 13 and the feed circuits 6, 7 being exposed outside. The ground plane 2 includes the first ground plane 21 and the second ground plane 22. The radiating element 3 of square shape is made of high conductivity metal and is soldered to the insulating area 11 of the insulating substrate 1. The antenna device 100 defines two holes 14 penetrating through the first and second isolating areas 12, 13, respectively. The holes 14 further penetrate through the radiating element 3. The antenna device 100 further defines a plurality of apertures 15 penetrating through the insulating substrate 1 and the ground plane 2 at one end thereof away from the radiating element 3. An amount of solder is dropped into the apertures 15 to electrically connect with the first and second ground planes 21, 22 so as to decrease the capacitance effect of the antenna device 100, and achieve a horizontal electrical length of less than quarter horizontal wavelength of the antenna device 100 at 2.4 GHz frequency band and a vertical electrical length of less than quarter vertical wavelength of the antenna device 100 at 2.4 GHz frequency band. In this invention, the insulating substrate 1 is made of a compound of epoxy resin with filler and glass fiber, the ground plane 2 and the radiating element 3 are made of brass.

Referring to FIGS. 1-3 again, the horizontal feed probe 4 and the vertical feed probe 5 are made of brass and each is of a solid cylinder. Diameter dimensions of the horizontal and vertical feed probes 4, 5 are mated with those of the holes 14. The horizontal feed probe 4 and the vertical feed probe 5 are respectively inserted into the holes 14 with tops thereof being projected above the radiating element 3. The horizontal feed circuit 6 and the vertical feed circuit 7 respectively make a coupling with the horizontal feed probe 4 and the vertical feed probe 5. So a horizontal polarized electromagnetic wave and a vertical polarized electromagnetic wave can be stirred to make the horizontal and vertical feed probes 4, 5 of the antenna device 100 work under a duplex mode.

In this invention, the antenna device 100 can work with an about 2.45 GHz frequency and has a thickness of 3.4 mm. A side length of the radiating element 3 is 25 mm. The horizontal feed probe 4 is located at a distance of 6.25 mm from one side edge of the radiating element 3, and at a distance of 8.33 mm from one end edge of the radiating element 3. The vertical feed probe 5 is located at a distance of 6.25 mm from the other end edge of the radiating element 3, and at a distance of 8.33 mm from the other side edge of the radiating element 3. The above-mentioned arrangements of the horizontal and vertical feed probes 4, 5 can make the resonance impedance of the antenna device 100 achieve a better matching effect.

Figure 4:
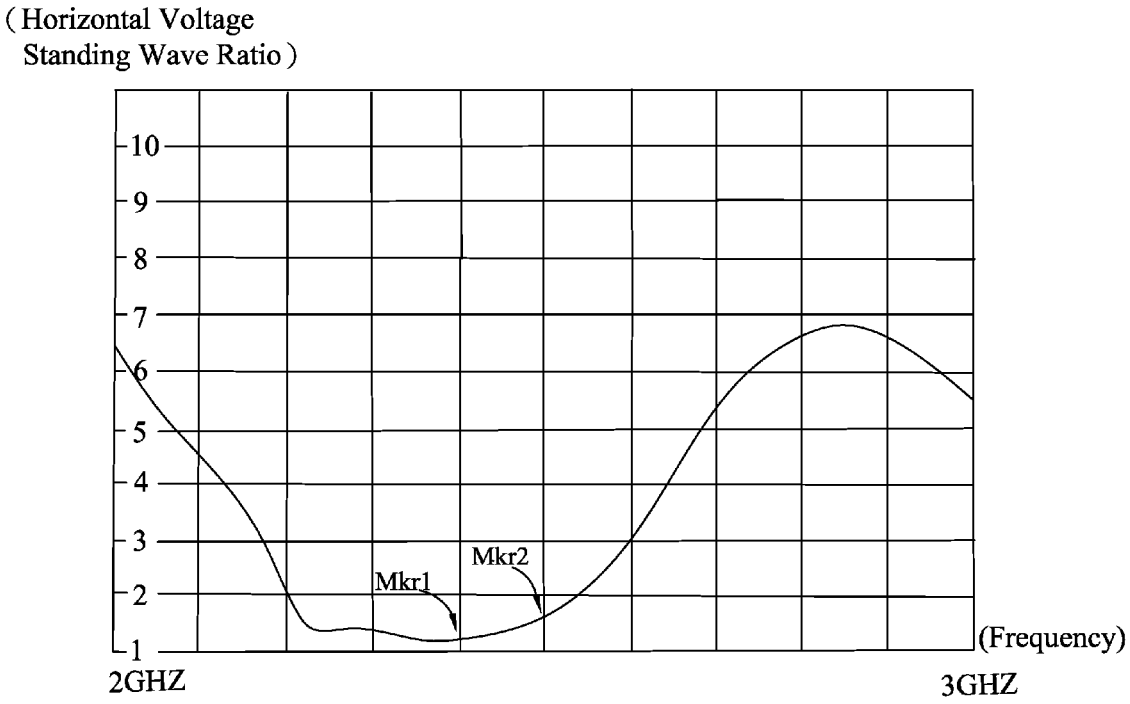
FIG. 4 is a test chart of horizontal voltage standing wave ratio of the antenna device of FIG. 1.

Referring to FIG. 4, it shows a test chart of horizontal voltage standing wave ratio of the antenna device 100 at wireless communication. When the antenna device 100 works with frequencies of 2.4 GHz (Mkr1) and 2.5 GHz (Mkr2) respectively, both the horizontal voltage standing wave ratios thereof are close to 1. It means that the antenna device 100 has an excellent horizontal frequency response between 2.4 GHz and 2.5 GHz.

Figure 5:
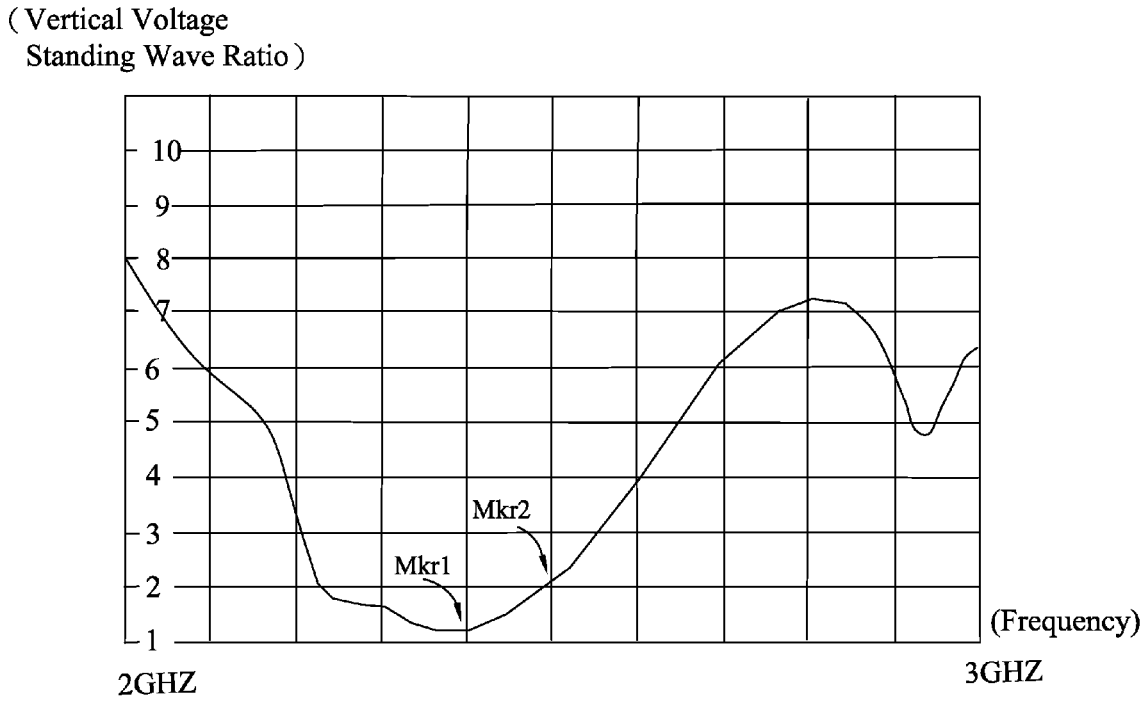
FIG. 5 is a test chart of vertical voltage standing wave ratio of the antenna device of FIG. 1.

Referring to FIG. 5, it shows a test chart of vertical voltage standing wave ratio of the antenna device 100 at wireless communication. When the antenna device 100 works with frequencies of 2.4 GHz (Mkr1) and 2.5 GHz (Mkr2) respectively, both the vertical voltage standing wave ratios thereof are close to 1. It means that the antenna device 100 has an excellent vertical frequency response between 2.4 GHz and 2.5 GHz.

Figure 6:
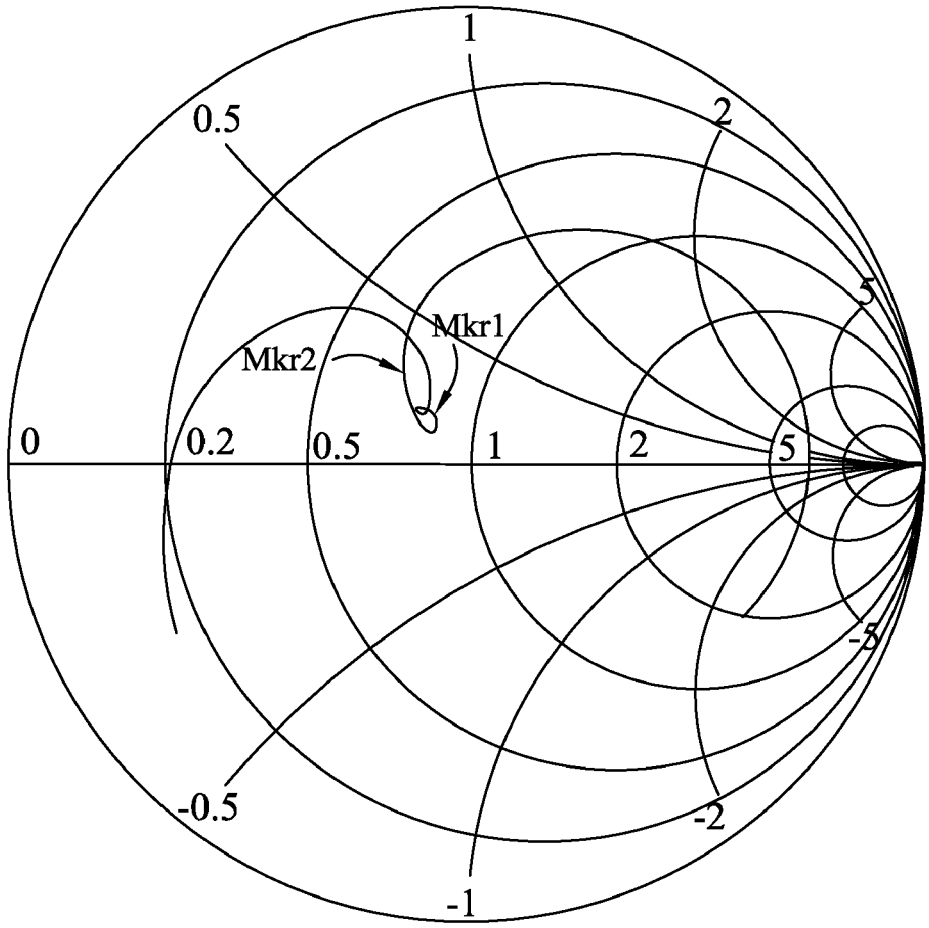
FIG. 6 is a horizontal feed Smith chart of the antenna device of FIG. 1.

Referring to FIG. 6, it shows a horizontal feed Smith chart of the antenna device 100 at wireless communication. When the antenna device 100 works between frequencies of 2.4 GHz (Mkr1) and 2.5 GHz (Mkr2), a well impedance matching characteristic is achieved between a horizontal input impedance and a horizontal feed impedance thereof.

Figure 7:
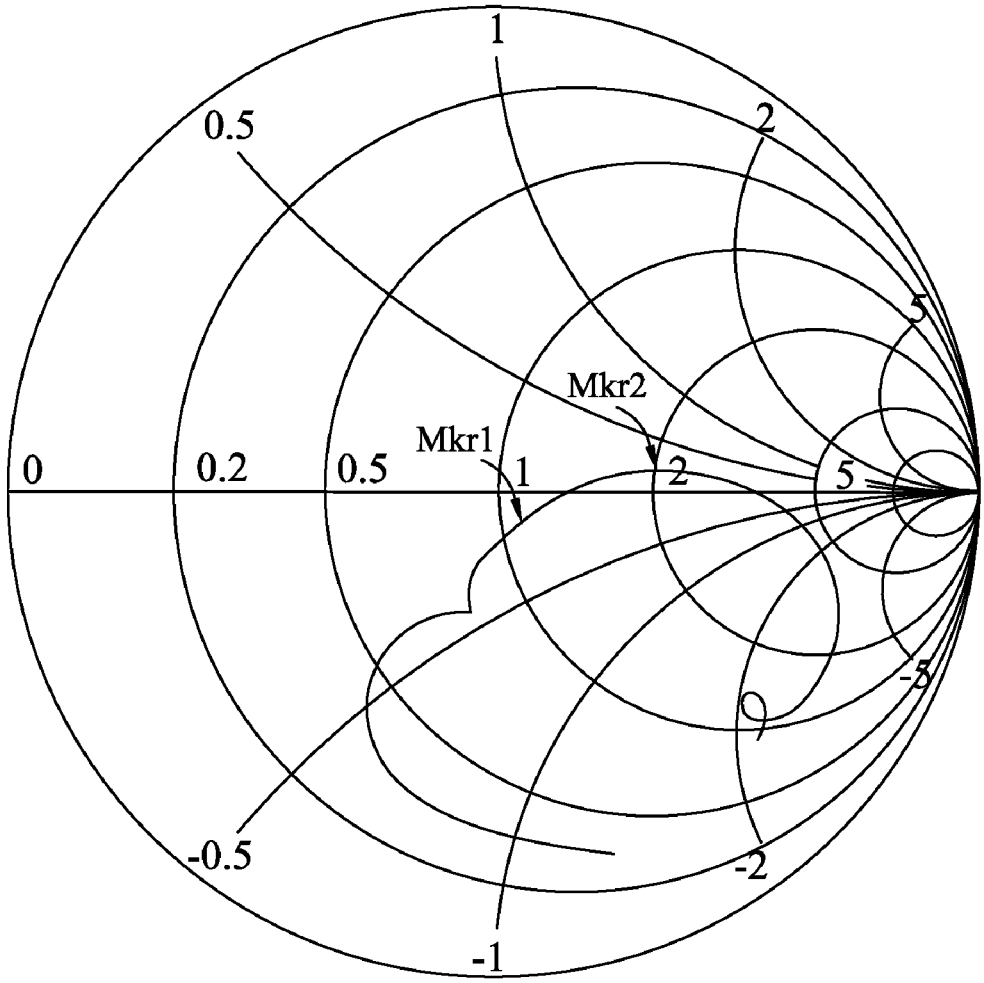
FIG. 7 is a vertical feed Smith chart of the antenna device of FIG. 1.

Referring to FIG. 7, it shows a vertical feed Smith chart of the antenna device 100 at wireless communication. When the antenna device 100 works between frequencies of 2.4 GHz (Mkr1) and 2.5 GHz (Mkr2), a well impedance matching characteristic is achieved between a vertical input impedance and a vertical feed impedance thereof.

Figure 8:
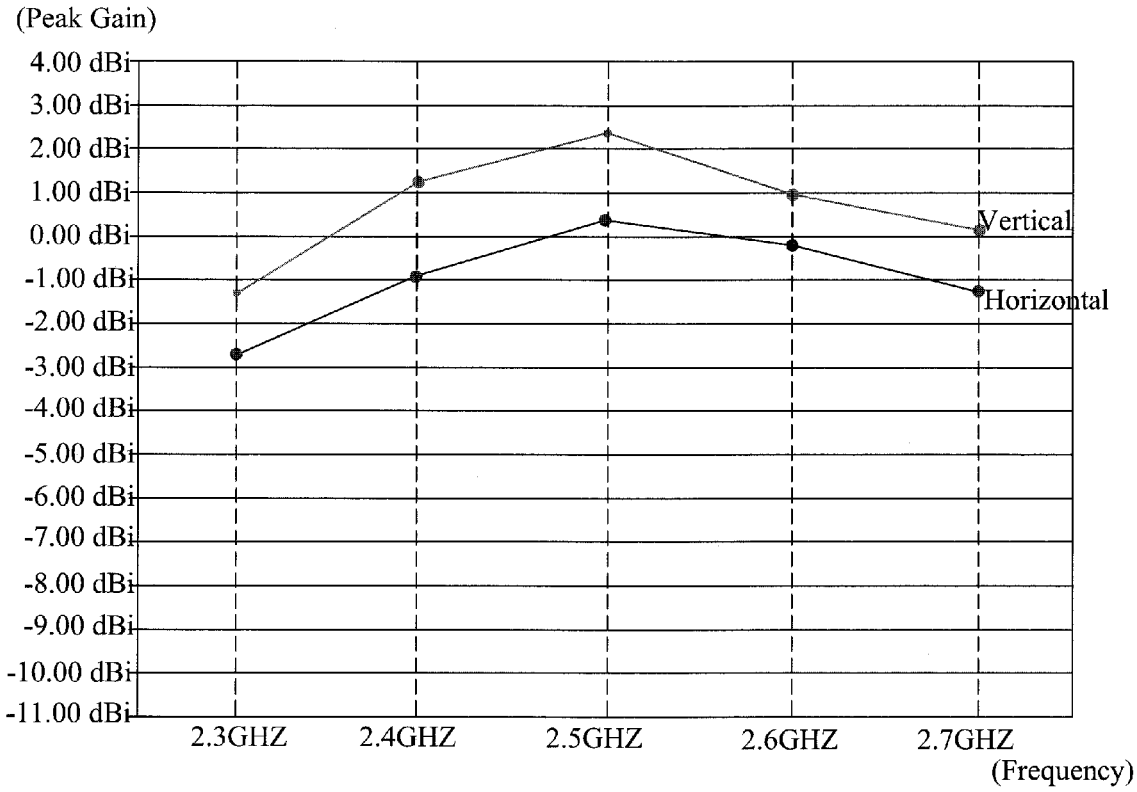
FIG. 8 is a test chart of a peak gain of the antenna device of FIG. 1.

Referring to FIG. 8, it shows a test chart of peak gain of the horizontal feed probe 4 and the vertical feed probe 5 of the antenna device 100. As the test chart is shown, when the antenna device 100 works at a band of 2.3 GHz, the maximum gain of the horizontal feed probe 4 gets up to −2.76 dBi and that of the vertical feed probe 5 gets up to −1.41 dBi. When the antenna device 100 works at a band of 2.4 GHz, the maximum gain of the horizontal feed probe 4 gets up to −0.9 dBi and that of the vertical feed probe 5 gets up to 1.25 dBi. When the antenna device 100 works at a band of 2.5 GHz, the maximum gains of the horizontal feed probe 4 and the vertical feed probe 5 respectively get up to 0.37 dBi and 2.41 dBi.

As described above, the proper arrangements of the horizontal and vertical feed probes 4, 5 on the radiating element 3 of the antenna device 100 can make the resonance impedance of the antenna device 100 achieve a better matching effect and reduce the occupied area of the radiating element 3 on the antenna device 100. Furthermore, the radiating element 3 is soldered to the insulating substrate 1 that simplifies manufacturing procedure of the antenna device 100.

What is claimed is:

1. An antenna device, comprising:

an insulating substrate having a first surface and a second surface opposite to the first surface, one end of the first surface defining an insulating area, one end of the second surface adjacent to the insulating area defining a first isolating area and a second isolating area spaced from each other, a horizontal feed circuit and a vertical feed circuit being disposed at the one end of the second surface and beside the first isolating area and the second isolating area, respectively;

a ground plane including a first ground plane which is covered on the first surface of the insulating substrate with the insulating area being exposed outside, and a second ground plane which is covered on the second surface of the insulating substrate with the first and second isolating areas being exposed outside and is further electrically connected with the first ground plane;

a radiating element located onto the insulating area of the insulating substrate; and a horizontal feed probe and a vertical feed probe inserted in the insulating substrate and the radiating element with one end thereof projecting beyond the radiating element and the other end thereof respectively penetrating through the first isolating area and the second isolating area so as to couple with the horizontal feed circuit and the vertical feed circuit, respectively.

2. The antenna device as claimed in claim 1, wherein the radiating element is made of high conductivity metal and shows a square shape with a 25 mm side length, the horizontal feed probe is located at a distance of 6.25 mm from one side edge of the radiating element and at a distance of 8.33 mm from one end edge of the radiating element, and the vertical feed probe is located at a distance of 6.25 mm from the other end edge of the radiating element and at a distance of 8.33 mm from the other side edge of the radiating element.

3. The antenna device as claimed in claim 1, wherein the first ground plane and the second ground plane are electrically connected with each other to achieve a horizontal electrical length of less than quarter horizontal wavelength of the antenna device at 2.4 GHz frequency band, and a vertical electrical length of less than quarter vertical wavelength of the antenna device at 2.4 GHz frequency band.

4. The antenna device as claimed in claim 1, wherein a plurality of apertures are defined to penetrate through the insulating substrate and the ground plane for receiving solder therein so as to electrically connect the first ground plane and the second ground plane.

5. The antenna device as claimed in claim 1, wherein the first ground plane and the second ground plane are formed by covering a layer of brass on the insulating substrate, respectively.

6. The antenna device as claimed in claim 1, wherein the radiating element is made of brass.

7. The antenna device as claimed in claim 1, wherein the feed probe is a brass solid cylinder.

* * * * *